US005611871A

United States Patent [19]

Yoshizawa et al.

[11] Patent Number: 5,611,871

[45] Date of Patent: Mar. 18, 1997

[54] METHOD OF PRODUCING NANOCRYSTALLINE ALLOY HAVING HIGH PERMEABILITY

[75] Inventors: Yoshihito Yoshizawa, Fukaya; Yoshio Bizen, Yasugi; Shin Nakajima; Shunsuke Arakawa, both of Kumagaya, all of Japan

[73] Assignee: Hitachi Metals, Ltd., Tokyo, Japan

[21] Appl. No.: 503,935

[22] Filed: Jul. 19, 1995

[30] Foreign Application Priority Data

Jul. 20, 1994 [JP] Japan ..... 6-168170

[51] Int. Cl.[6] ..... C21D 1/04

[52] U.S. Cl. ..... 148/108; 148/121

[58] Field of Search ..... 148/101, 121, 148/122, 108

[56] References Cited

U.S. PATENT DOCUMENTS 4,881,989 11/1989 Yoshizawa et al. ..... 148/302
5,255,144 10/1993 Martis ..... 148/122
5,439,534 8/1995 Takeuchi et al. ..... 148/122

FOREIGN PATENT DOCUMENTS 0342923 11/1989 European Pat. Off. ..... 148/121
1-242755 9/1989 Japan .

*Primary Examiner*—John Sheehan
*Attorney, Agent, or Firm*—Sughrue, Mion, Zinn, Macpeak & Seas

[57] ABSTRACT

A method for producing a nanocrystalline alloy wherein an amorphous alloy is heat-treated by keeping the temperature at a first heat treatment temperature higher than the crystallization temperature of the amorphous alloy for 0 to less than 5 minutes, and is cooled to room temperature at a cooling rate of 20° C./min or more at least until the temperature falls to 400° C. The amorphous alloy subjected to the first heat treatment may be further heat-treated at a second heat treatment temperature not higher than 500° C. and lower than the first heat treatment temperature while applying a magnetic field. The nanocrystalline alloy produced by the method of the invention has a extremely high specific initial permeability as compared with the conventional nanocrystalline alloy, and is suitable for use in magnetic core of transformers, choke coils, etc.

5 Claims, 5 Drawing Sheets

METHOD OF PRODUCING NANOCRYSTALLINE ALLOY HAVING HIGH PERMEABILITY

BACKGROUND OF THE INVENTION

The present invention relates to a method of producing a nanocrystalline alloy having an extremely high permeability, which is used in various magnetic parts of transformers, choke coils, etc.

As a material for a magnetic core of a common-mode choke coil used in a noise filter, a pulse transformer, etc., a high permeability material having excellent high-frequency properties such as ferrite, amorphous alloy, etc. has been used. The material for a magnetic core of common-mode choke coil used in a noise filter (line filter) is further required to have an excellent pulse attenuation characteristics for preventing disordered operation of an apparatus equipped therewith due to high-voltage pulse noise caused by thunder, a large inverter, etc. However, since the ferrite material, which has been conventionally used, is low in saturation magnetic flux density, it easily reaches a magnetically-saturated state. This means that a small-sized magnetic core made of the ferrite material cannot show a sufficient efficiency to fail to meet the above requirements. Therefore, a large-sized core is necessary for obtaining a high efficiency when ferrite is used as the core material.

An Fe-based amorphous alloy has a high saturation magnetic flux density and shows, with respect to a high-voltage pulse noise, excellent attenuation characteristics as compared with the ferrite material. However, since the permeability of the Fe-based amorphous alloy is lower than that of a Co-based amorphous alloy, it shows insufficient attenuation to a low-voltage noise. In addition, the Fe-based amorphous alloy shows a remarkably large magnetostriction. This invites further problems such as alteration in its properties caused by a resonance with vibration due to magnetostriction at a certain frequency, and beating of the magnetic core when a current having audio frequency component flows through a coil.

A Co-based amorphous alloy shows a large attenuation to low-voltage noise due to its high permeability. However, since the saturation magnetic flux density is lower than 1 T, the Co-based amorphous alloy shows poor attenuation to high-voltage pulse noise as compared with an Fe-based amorphous alloy. Further, the Co-based amorphous alloy of a high permeability is lacking in reliability due to its significant deterioration of properties with time, in particular under environment of a high ambient temperature.

A material for magnetic core of a pulse transformer which is used in an interface to the ISDN (Integrated Services Digital Network) is required to have a high permeability, in particular, at around 20 kHz and a high stability of properties against temperature. In some applied use, a material showing a flat B-H loop having a low remanence ratio is required, however, a material having a specific initial permeability of 100000 or more has been difficult to be obtained. Recently, the application of the pulse transformer to card-type interface has come to be considered. This requires a small-sized and thin pulse transformer which satisfies the restriction of an inductance of 20 mH or more at 20 kHz. To meet such requirement, the material is necessary to have a still more higher permeability. Further, a material showing a flat B-H loop having a low remanence ratio and having a stability in permeability is also required for a high fidelity transmission.

However, ferrite and an Fe-based amorphous alloy cannot satisfy the above demand due to their low permeability. Ferrite has another demerit that the permeability thereof largely depends on temperature, in particular, it is drastically lowered at a temperature lower than room temperature. Although a high permeability can be obtained, the Co-based amorphous alloy shows a large change with time in its permeability at a high ambient temperature and is expensive, therefore, the application of such an alloy to a wide use is restricted.

A material having a high permeability is further required in an electric sensor used in electrical leak alarm, etc. and a magnetic sensor in view of a small size and a high sensitivity. Further, a highly permeable material showing a flat B-H loop having a low remanence ratio and having a stability in permeability is required for a linear output.

A nanocrystalline alloy (fine crystalline alloy) has been used to produce a magnetic core of common-mode choke coils, high-frequency transformers, electrical leak alarms, pulse transformers, etc. because of its excellent soft magnetic properties. Typical examples for such a nanocrystalline alloy are disclosed in U.S. Pat. No. 4,881,989 and JP-A-1-242755. The nanocrystalline alloy known in the art has been generally produced by subjecting an amorphous alloy obtained by quenching a molten or vaporized alloy to a heat treatment for forming fine crystals. A method for quenching a molten metal may include a single roll method, a twin roll method, a centrifugal quenching method, a rotation spinning method, an atomization method, a cavitation method, etc. A method for quenching a vaporized metal may include a sputtering method, a vapor deposition method, an ion plating method, etc. The nanocrystalline alloy is produced by finely crystallizing an amorphous alloy produced by the above method, and is known to have, contrary to amorphous alloys, a good heat stability as well as a high saturation magnetic flux density, a low magnetostriction, and a good soft magnetic property. The nanocrystalline alloy is also known to show a little change with time in its properties and have a good temperature stability. Specifically, the Fe-based nanocrystalline alloy disclosed in U.S. Pat. No. 4,881,989 is described t o have a high permeability and a low magnetic core loss, and therefore, suitable for the use mentioned above.

As mentioned above, a magnetic core for a common-mode choke used in a noise filter, a pulse transformer for use in ISDN, etc. are required to have a high specific permeability. U.S. Pat. No. 4,881,989 disclose heat-treating an amorphous alloy at 450°–700° C. for 5 minutes to 24 hours. However, a nanocrystalline alloy produced by the conventional heat treatment method cannot attain a high specific initial permeability exceeding 100000.

OBJECT AND SUMMARY OF THE INVENTION

Accordingly, an object of the present invention is to provide a method for producing a nanocrystalline alloy having an extremely high specific initial permeability.

As a result of the intense research in view of the above object, the inventors have found that a nanocrystalline alloy having a specific initial permeability of 100000 or more can be produced, without applying a magnetic field, by heating an amorphous alloy from a temperature lower than the crystallization temperature of the amorphous alloy to a heat treatment temperature higher than the crystallization temperature, maintaining the heat treatment temperature for 0 to less than 5 minutes, and cooling the resultant alloy at a cooling rate of 20° C. /min at least until the temperature reaches 400° C. The present invention has been accomplished based on this finding.

In a fist aspect of the present invention, there is provided a method for producing a nanocrystalline alloy comprising (a) heating an amorphous alloy from a temperature lower than the crystallization temperature of the amorphous alloy to a first heat treatment temperature higher than the crystallization temperature, the amorphous alloy having a chemical composition represented by the following formula:

$$(Fe_{1-a}M_a)_{100-x-y-z-b-c-d}A_xM'_yM''_zX_bSi_cB_d \text{ (by atomic \%)},$$

wherein M is at least one element selected from the group consisting of Co and Ni, A is at least one element selected from the group consisting of Cu and Au, M' is at least one element selected from the group consisting of Ti, V, Zr, Nb, Mo, Hf, Ta and W, M" is at least one element selected from the group consisting of Cr, Mn, Sn, Zn, Ag, In, platinum group elements, Mg, Ca, Sr, Y, rare earth elements, N, O and S, X is at least one element selected from the group consisting of C, Ge, Ga, Al and P, and each of a, x, y, z, b, c and d respectively satisfies $0 \leqq a \leqq 0.1$, $0.1 \leqq x \leqq 3$, $1 \leqq y \leqq 10$, $0 \leqq z \leqq 10$, $0 \leqq b \leqq 10$, $11 \leqq c \leqq 17$ and $3 \leqq d \leqq 10$; (b)keeping the first heat treatment temperature for 0 to less than 5 minutes; and (c) cooling the heat-treated amorphous alloy to room temperature at a cooling rate of 20° C./min or more at least until the temperature falls to 400° C.

In a second aspect of the present invention, there is provided a method for producing a nanocrystalline alloy comprising (a) heating an amorphous alloy from a temperature lower than the crystallization temperature of the amorphous alloy to a first heat treatment temperature higher than the crystallization temperature, the amorphous alloy having a chemical composition represented by the following formula:

$$(Fe_{1-a}M_a)_{100-x-y-z-b-c-d}A_xM'_yM''_zX_bSi_cB_d \text{ (by atomic \%)},$$

wherein M is at least one element selected from the group consisting of Co and Ni, A is at least one element selected from the group consisting of Cu and Au, M' is at least one element selected from the group consisting of Ti, V, Zr, Nb, Mo, Hf, Ta and W, M" is at least one element selected from the group consisting of Cr, Mn, Sn, Zn, Ag, In, platinum group elements, Mg, Ca, Sr, Y, rare earth elements, N, O and S, X is at least one element selected from the group consisting of C, Ge, Ga, Al and P, and each of a, x, y, z, b, c and d respectively satisfies $0 \leqq a \leqq 0.1$, $0.1 \leqq x \leqq 3$, $1 \leqq y \leqq 10$, $0 \leqq z \leqq 10$, $0 \leqq b \leqq 10$, $11 \leqq c \leqq 17$ and $3 \leqq d \leqq 10$; (b) keeping the first heat treatment temperature for 0 to less than 5 minutes; (c) cooling the amorphous alloy subjected to a first heat treatment to a second heat treatment temperature not higher than 500° C. and lower than the first heat treatment temperature; (d) keeping the second heat treatment temperature while applying a magnetic field for 2 hours or less; and (e) cooling the amorphous alloy subjected to the second heat treatment to room temperature at a cooling rate of 20° C./min or more at least until the temperature falls to 400° C.

DETAILED DESCRIPTION OF THE INVENTION

Figure 1:
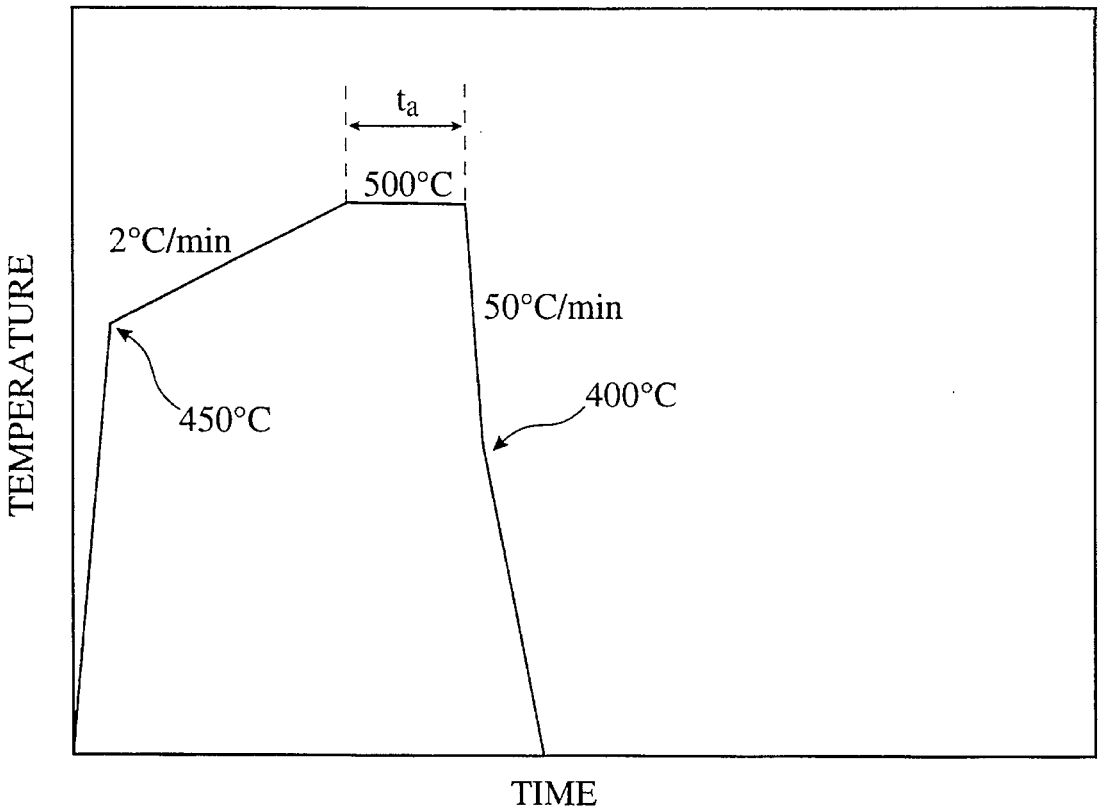
FIG. 1 is a graph showing the heat treatment pattern of the present invention employed in Example 1.

The amorphous alloy used in the present invention preferably has a chemical composition represented by the following formula:

$$(Fe_{1-a}M_a)_{100-x-y-z-b-c-d}A_xM'_yM''_zX_bSi_cB_d \text{ (by atomic \%)},$$

wherein M is at least one element selected from the group consisting of Co and Ni, A is at least one element selected from the group consisting of Cu and Au, M' is at least one element selected from the group consisting of Ti, V, Zr, Nb, Mo, Hf, Ta and W, M" is at least one element selected from the group consisting of Cr, Mn, Sn, Zn, Ag, In, platinum group elements, Mg, Ca, Sr, Y, rare earth elements, N, O and S, X is at least one element selected from the group consisting of C, Ge, Ga, Al and P, and each of a, x, y, z, b, c and d respectively satisfies $0 \leqq a \leqq 0.1$, $0.1 \leqq x \leqq 3$, $1 \leqq y \leqq 10$, $0 \leqq z \leqq 10$, $0 \leqq b \leqq 10$, $11 \leqq c \leqq 17$ and $3 \leqq d \leqq 10$. From an amorphous alloy having a chemical composition outside the above formula, it is impossible to produce a nanocrystalline alloy having a specific initial permeability higher than 100000 even when the heat treatment method of the present invention which will be described below is employed.

The nanocrystalline alloy made of such an amorphous alloy by the method of the present invention contains fine crystals having an average grain size of 30 nm or less, preferably in an area ratio of 50% or more. The fine crystals mainly comprise bcc Fe-phase (body centered cubic lattice phase) containing Si, and may contain an ordered lattice phase. Alloying elements other than Si, i.e., B, Al, Ge, Zr, etc. may be contained as a solid solution component in the bcc Fe-phase. The remaining part other than the crystal phase mainly comprises amorphous phase. However, a nanocrystalline alloy substantially comprising only crystal phase is also embraced within the scope of the present invention.

The specific initial permeability which is determined from the initial magnetization curve of the direct current B-H loop remains constant or falls with increasing frequency of current. Therefore, a nanocrystalline alloy having a specific initial permeability ($\mu_{ir}$) (effective specific permeability ge) of 100000 or more at a frequency of about 50 Hz to about 1 kHz when measured under an exciting level of 0.05 A/m or less is also embraced within the scope of the present invention.

The nanocrystalline alloy of the present invention is produced by heat-treating a magnetic core of the amorphous alloy having the above chemical composition prepared by a super quenching method such as a single roll method, etc. under a specific heat treatment condition, thereby forming fine crystals having an average grain size of 30 nm or less.

In detail, the amorphous alloy is heated from a temperature lower than the crystallization temperature of the amorphous alloy to a first heat treatment temperature higher than the crystallization temperature. The upper limit of the elevated temperature is about 700° C. Then the temperature is kept constant at the first heat treatment temperature for 0 to less than 5 minutes, preferably 0 to 3 minutes. The amorphous alloy thus treated is then cooled to room temperature at a cooling rate of 20° C./min or more, preferably 30° to 400° C./min at least until the temperature falls to 400° C.

It has been known in the art that the temperature should be kept for at least 5 minutes to attain uniformity of properties from product to product. However, contrary to the conventional method, the inventors have found that the retaining period of time of 0 to less than 5 minutes is preferable to attain a specific initial permeability exceeding 100000. It has been further found that the uniformity of properties comparable to that obtained in the conventional method can be achieved by controlling the heating rate to 0.2° to 30° C./min, preferably 1° to 10° C./min. It has been also found that the crystallization proceeds considerably during the heating, and therefore, a retaining period of time of 5 minutes or longer is not important for crystallization and improvement in properties. On the contrary, a retaining period of time of 5 minutes or longer disadvantageously lowers the specific initial permeability due to induced magnetic anisotropy undesirably occurred during the temperature is kept constant.

After keeping the temperature constant at the first heat treatment temperature for 0 to less than 5 minutes, the heat-treated amorphous alloy is cooled to room temperature to obtain the nanocrystalline alloy. During cooling, it is important to cool at a cooling rate of 20° C./min or more at least until the temperature falls to 400° C. When cooled at a cooling rate less than 20° C./min, a high specific initial permeability cannot be attained because of induced magnetic anisotropy undesirably occurred.

The nanocrystalline alloy thus obtained may be further heated t o a second heat treatment temperature of 500° C. or lower and preferably higher than 250° C. and lower than the first heat treatment temperature with or without applying a magnetic field. Although not specifically restricted, the heating rate is preferably 0.2° to 100° C./min. The temperature is then kept constant at the second heat treatment temperature or kept in the range from 250° to 500° C. under the influence of a magnetic field. After heat treatment, the nanocrystalline alloy is cooled to room temperature at a cooling rate of 20° C./min or more, preferably 30° to 400° C./min at least until the temperature falls to 400° C. with or without applying a magnetic field.

Alternatively, the amorphous alloy subjected to the first heat treatment may be cooled, without cooling to room temperature, to a second heat treatment temperature of 500° C. or lower and preferably higher than 250° C. and lower than the first heat treatment temperature at a cooling rate of 20° C./min or more, preferably 30° to 400° C./min at least until the temperature falls to 400° C. The temperature is then kept constant at the second heat treatment temperature or kept in the range from 250° to 500° C. under the influence of a magnetic field. The heat-treated product is then cooled to room temperature at a cooling rate of 20° C./min or more, preferably 30° to 400° C./min at least until the temperature fails to 400° C. with or without applying a magnetic field.

Although the heat-treating time under a magnetic field depends on the intended value of the permeability, it is preferably 2 hours or less, more preferably 1 hour or less, and particularly preferably 30 minutes or less in view of obtaining a high specific initial permeability.

By the second heat treatment while applying a magnetic field at a temperature lower than the first heat treatment temperature, a nanocrystalline alloy having a high specific initial permeability and a low remanence ratio can be obtained. Since, in the present invention, the retaining period of time after elevated to the crystallization temperature or higher is shorter than that of the conventional method, induced magnetic anisotropy which leads to various directions of easy magnetization axes hardly occur. Therefore, anisotropy of random orientation can be effectively prevented by the heat treatment under a magnetic field even at a relatively low temperature, this resulting in a low remanence ratio and a high specific initial permeability. Further, the frequency characteristics of the permeability is also improved, in particular, a higher permeability than in the case of the heat treatment with no magnetic field can be attained at a high frequency.

The magnetic field may be applied in the direction slightly deviating from the width direction or the thickness direction of the thin alloy ribbon. However, a low remanence ratio and a high permeability can be easily achieved when applied along the width direction or the thickness direction. These directions correspond to the height direction and radial direction of a wound magnetic core.

The strength of the applied magnetic field is usually 80 kA/m or more. The magnetic field having a strength enough to magnetically saturate the nanocrystalline alloy should be applied. Therefore, the higher the magnetic field strength is, the more preferred for the saturation, however, it is not necessarily required to apply a magnetic field higher than that sufficient for saturating the nanocrystalline alloy.

The thickness of the thin alloy ribbon is usually from about 2 μm to about 50 μm. A thin alloy ribbon of 15 μm thick or less is particularly suitable for a magnetic core for use in common-mode choke of a noise filter or a magnetic core of use in a high-frequency transformer, because good frequency characteristics, in particular, in the permeability and magnetic core loss can be attained. The width may be selected depending on the use.

The heat treatment is preferred to be carried out in a gaseous atmosphere such as a nitrogen atmosphere, an argon atmosphere and an helium atmosphere, because of a little deterioration in the soft magnetic properties. The oxygen content in the atmosphere is preferred to be low, preferably 1% or less, more preferably 0.1% or less and particularly preferably 0.01% or less by volume ratio because the oxygen in the atmosphere adversely affects the permeability. When a large-size magnetic core or a large number of the magnetic cores are heat-treated, a circulating furnace is preferably used.

The dew point of the gaseous atmosphere is preferably −30° C. or lower. When the dew point exceeds −30° C., the magnetic properties such as permeability, etc. of the resulting alloy is deteriorated due to the corroded layer formed on the alloy surface. A gaseous atmosphere having a dew point of −60° C. or lower is particularly preferred because the magnetic properties are more effectively improved. The dew point of −30° C. corresponds to the moisture content of 337.7 mg/m$^3$, and the dew point of −60° C. corresponds to the moisture content of 10.93 mg/m$^3$.

The nanocrystalline alloy or the magnetic core made thereof may be provided with layer insulation by forming on at least one surface thereof a coating of powder or film of $SiO_2$, $MgO,Al_2O_3$, etc., and subsequently subjecting the coated product to surface treatment such as a chemical conversion and an anode polarization treatment. The layer insulation is effective for improving the permeability and magnetic core loss because it minimizes the affect of eddy current induced by high-frequency current. The layer insulation is particularly effective for a magnetic core made of a wide alloy ribbon having a good surface state, for example, having a small surface roughness.

The present invention will be further described while referring to the following non-limitative Examples.

EXAMPLE 1

An amorphous alloy ribbon having a width of 6.5 mm and a thickness of 18 μm was produced by quenching a molten alloy of $Fe_{bal.}Cu_1Nb_{3.2}Si_{15.4}B_{6.6}$ (atomic %) by using a single roll method. The measured crystallization temperature of the amorphous alloy was 506° C. The amorphous alloy ribbon was wound to form a toroidal shape of 20 mm outer diameter and 10 mm inner diameter, and then introduced into a heat treatment furnace of 450° C. to be subjected to heat treatment in an argon atmosphere according to the heat treatment pattern shown in FIG. 1 to produce toroidal magnetic cores (Sample Nos. 1 to 3) made of the nanocrystalline alloy. The retaining times (shown by $t_a$ in FIG. 1) were 0, 2 and 4 minutes for Sample Nos. 1 to 3, respectively.

For comparison, toroidal magnetic cores (Sample Nos. 4 to 7) were produced from the same amorphous alloy ribbon while changing the retaining time to 5, 15, 30 and 60 minutes, respectively. The specific initial permeability and the remanence ratio of each magnetic core are shown in Table 1. In Table 1, $B_{800}$ is a magnetic flux density when a magnetic field of 800 A/m is applied, and $B_r$ is a residual magnetic flux density.

Further, the same procedure as above was repeated while using a molten alloy having a composition of $Fe_{bal.}Cu_1Nb_3Si_{10}B_9$ (atomic %)which is outside the composition of the present invention (Sample Nos. 8 to 14). The results are also shown in Table 1.

TABLE 1

| Sample No. | Composition (atomic %) | Retaining Time $t_a$ (minute) | Specific Initial Permeability $\mu_{ir}$ | Remanence Ratio $B_r/B_{800}$ (%) |
|---|---|---|---|---|
| Invention | | | | |
| 1 | $Fe_{bal.}Cu_1Nb_{3.2}Si_{15.4}B_{6.6}$ | 0 | 112000 | 66 |
| 2 | $Fe_{bal.}Cu_1Nb_{3.2}Si_{15.4}B_{6.6}$ | 2 | 106000 | 61 |
| 3 | $Fe_{bal.}Cu_1Nb_{3.2}Si_{15.4}B_{6.6}$ | 4 | 101000 | 62 |
| Comparison | | | | |
| 4 | $Fe_{bal.}Cu_1Nb_{3.2}Si_{15.4}B_{6.6}$ | 5 | 98000 | 60 |
| 5 | $Fe_{bal.}Cu_1Nb_{3.2}Si_{15.4}B_{6.6}$ | 15 | 94000 | 59 |
| 6 | $Fe_{bal.}Cu_1Nb_{3.2}Si_{15.4}B_{6.6}$ | 30 | 91000 | 62 |
| 7 | $Fe_{bal.}Cu_1Nb_{3.2}Si_{15.4}B_{6.6}$ | 60 | 87000 | 64 |
| 8 | $Fe_{bal.}Cu_1Nb_3Si_{10}B_9$ | 0 | 44000 | 52 |
| 9 | $Fe_{bal.}Cu_1Nb_3Si_{10}B_9$ | 2 | 43000 | 53 |
| 10 | $Fe_{bal.}Cu_1Nb_3Si_{10}B_9$ | 4 | 42000 | 55 |
| 11 | $Fe_{bal.}Cu_1Nb_3Si_{10}B_9$ | 5 | 40000 | 59 |
| 12 | $Fe_{bal.}Cu_1Nb_3Si_{10}B_9$ | 15 | 39000 | 60 |
| 13 | $Fe_{bal.}Cu_1Nb_3Si_{10}B_9$ | 30 | 38000 | 58 |
| 14 | $Fe_{bal.}Cu_1Nb_3Si_{10}B_9$ | 60 | 37000 | 59 |

Figure 2:
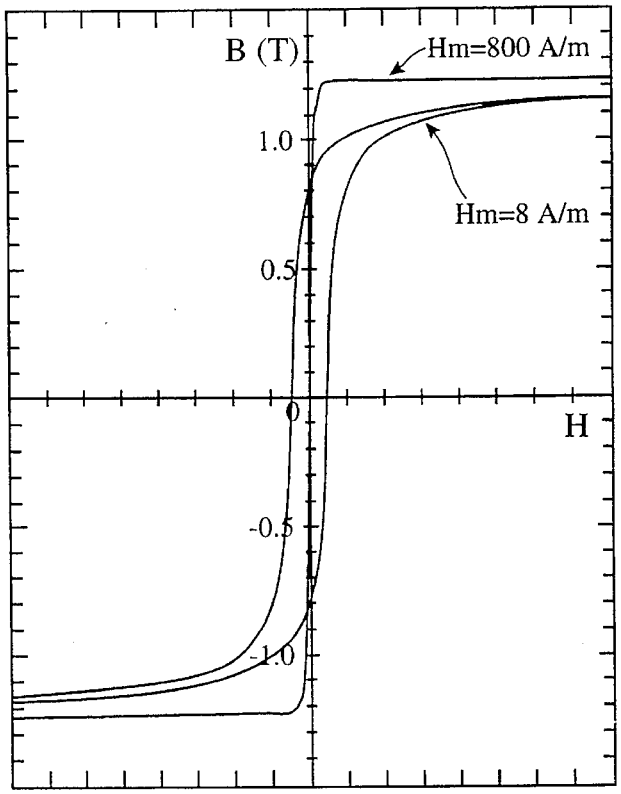
FIG. 2 is a graph showing direct current B-H loops of the nanocrystalline alloy produced by the method of the present invention.
Figure 3:
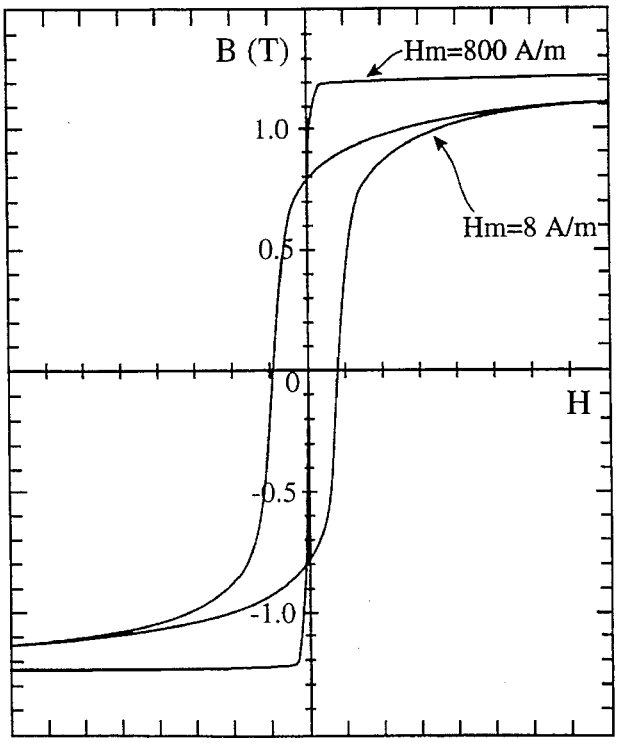
FIG. 3 PRIOR ART
FIG. 3 is a graph showing direct current B-H loops of the nanocrystalline alloy produced by a conventional method.

As seen from Table 1, all the nanocrystalline alloy Nos. 1 to 3 produced by the heat treatment of the present invention had the specific initial permeability of larger than 100000. The nanocrystalline alloy Nos. 4 to 7 which were retained at the first heat treatment temperature (550° C.) for 5 minute or more had, without exception, the specific initial permeability of less than 100000. The direct current B-H loops of the nanocrystalline alloy Nos. 1 and 4 are respectively shown in FIGS. 2 and 3. From the comparison of FIGS. 2 and 3, it can be seen that the nanocrystalline alloy No. 1 produced by the method of the present invention had a coercive force smaller than that of the conventional nanocrystalline alloy No. 4 subjected to the conventional heat treatment. As compared to the conventional heat treatment, the heat treatment of the present invention causes less induced magnetic anisotropy. Therefore it can be assumed that the magnetic domains less bound together in the nanocrystalline alloy of the present invention gives a high permeability. Further, the nanocrystalline alloy having a composition outside the present invention failed to have a specific initial permeability exceeding 100000 even when subjected to the heat treatment of the present invention.

EXAMPLE 2

Figure 4:
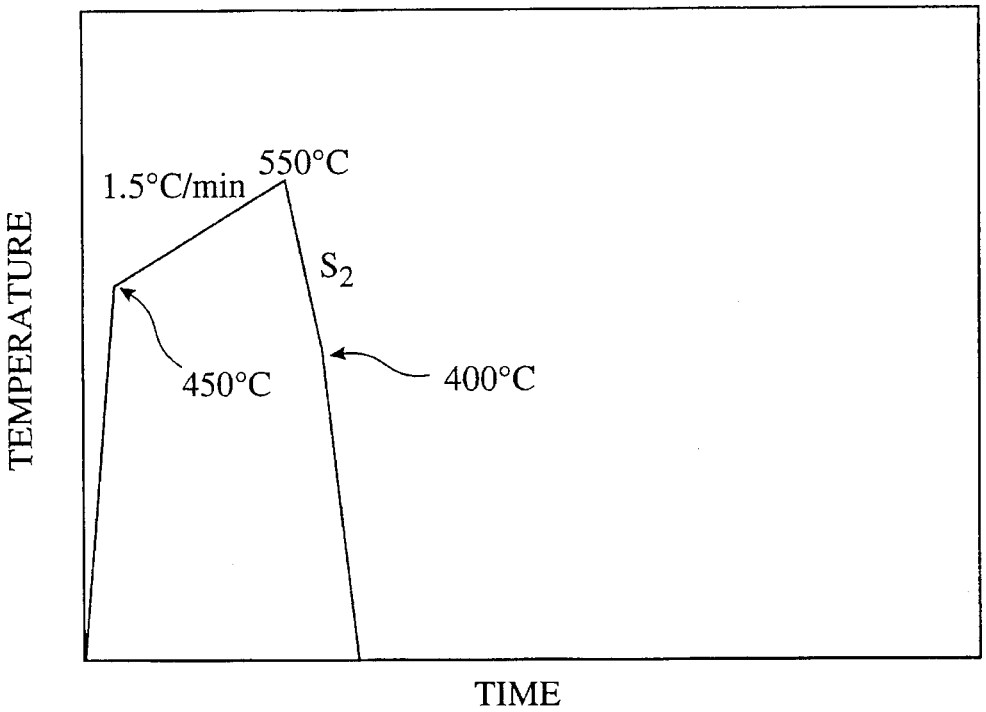
FIG. 4 is a graph showing the heat treatment pattern of the present invention employed in Example 2.

An amorphous alloy ribbon having a width of 5 mm and a thickness of 6 μm was produced by quenching a molten alloy of $Fe_{bal.}Cu_1Nb_3Si_{13.8}B_{8.5}$ (atomic %) by using a single roll method in a reduced helium atmosphere. The measured crystallization temperature of the amorphous alloy was 523° C. The amorphous alloy ribbon coated with $SiO_2$ was wound to form a toroidal shape of 19 mm outer diameter and 15 mm inner diameter, and then introduced into a heat treatment furnace to be subjected to heat treatment in an argon atmosphere according to the heat treatment pattern shown in FIG. 4. The temperature was raised at a heating rate of 1.5° C./min, and immediately after reaching 550° C. lowered at an average cooling rate of $S_2$ until the temperature fell to 400° C. The specific initial permeability of each resultant magnetic cores is shown in Table 2.

TABLE 2

| Sample No. | Cooling Rate $S_2$ (°C./min) | Specific Initial Permeability $\mu_{ir}$ |
|---|---|---|
| Comparison | | |
| 15 | 2 | 81000 |
| 16 | 5 | 86000 |
| 17 | 10 | 94000 |
| Invention | | |
| 18 | 20 | 100000 |
| 19 | 40 | 103000 |
| 20 | 50 | 108000 |
| 21 | 75 | 112000 |

As seen from Table 2, the specific initial permeability exceeding 100000 was attained when the cooling rate was 20° C./min or more. However, the cooling rate smaller than 20° C./min did not provide a specific initial permeability exceeding 100000.

EXAMPLE 3

Figure 5:
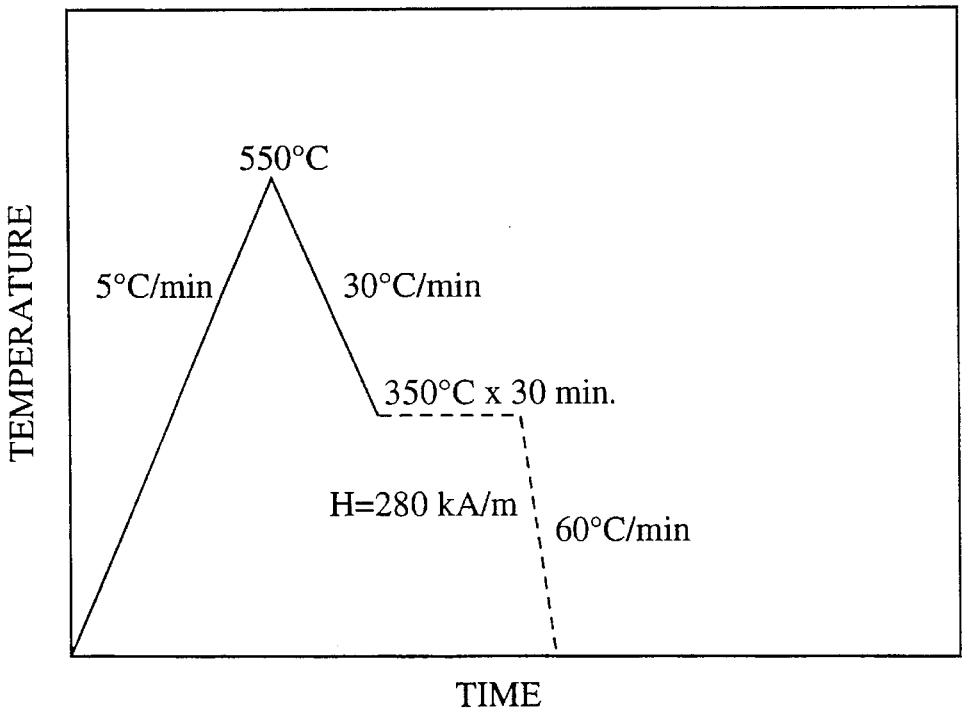
FIG. 5 is a graph showing the heat treatment pattern of the present invention employed in Example 3.

An amorphous alloy ribbon having a width of 12.5 mm and a thickness of 18 μm was produced by quenching a molten alloy having a chemical composition shown in Table 3 by using a single roll method. The amorphous alloy ribbon was wound to form a toroidal shape of 20 mm outer diameter and 14 mm inner diameter, and then introduced into a heat treatment furnace to be subjected to heat treatment in an argon atmosphere according to the heat treatment pattern shown in FIG. 5. In FIG. 5, the broken line means that the heat treatment and the cooling were conducted while applying a magnetic field of 280 kA/m in the width direction of the alloy ribbon. The remanence ratio and specific initial permeability of each resultant magnetic core are shown in Table 3.

TABLE 3

| Sample No. | Chemical Composition (atomic %) | Remanence Ratio $B_r/B_{800}$ (%) | Specific Initial Permeability $\mu_{ir}$ |
|---|---|---|---|
| Invention | | | |
| 22 | $Fe_{bal.}Cu_{0.8}Ta_{3.1}Si_{13.5}B_9$ | 9 | 108000 |
| 23 | $Fe_{bal.}Cu_1Nb_3Si_{14.5}B_{8.5}$ | 8 | 112000 |
| 24 | $Fe_{bal.}Cu_{1.5}Nb_{4.5}Si_{13.8}B_{9.5}$ | 7 | 109000 |
| 25 | $(Fe_{0.99}Co_{0.01})_{bal.}Cu_1Nb_3Ta_{0.3}Si_{15}B_7$ | 10 | 100000 |
| 26 | $Fe_{bal.}Cu_1Nb_{2.5}Hf_{0.5}Si_{15.5}B_7Sn_{0.1}$ | 11 | 102000 |
| 27 | $Fe_{bal.}Cu_1Nb_{3.5}Si_{15}B_{6.5}Ga_{0.5}$ | 9 | 111000 |
| 28 | $(Fe_{0.99}Ni_{0.01})_{bal.}Cu_1Nb_{3.5}Mo_{0.2}Si_{16}B_5Al_2$ | 9 | 100100 |
| 29 | $Fe_{bal.}Au_1Nb_{3.2}V_{0.7}Si_{14.5}B_{6.5}Ge_1$ | 12 | 101100 |
| 30 | $Fe_{bal.}Cu_1Nb_2Zr_1Si_{15.5}B_{6.5}$ | 11 | 102000 |
| 31 | $Fe_{bal.}Cu_1Nb_{3.5}W_{0.5}Si_{17}B_5$ | 12 | 103000 |
| 32 | $Fe_{bal.}Cu_1Nb_3Si_{15.5}B_{6.5}S_{0.001}$ | 12 | 104000 |
| 33 | $Fe_{bal.}Cu_1Nb_{3.5}Si_{15.7}B_{6.5}N_{0.001}$ | 12 | 105000 |
| 34 | $Fe_{bal.}Cu_1Nb_{3.3}Cr_{0.2}Si_{15.5}B_{6.5}P_{0.2}$ | 8 | 101000 |
| 35 | $Fe_{bal.}Cu_1Nb_3Mn_{0.3}Si_{15.5}B_{6.5}$ | 9 | 132000 |
| 36 | $Fe_{bal.}Cu_1Nb_3Si_{15.4}B_{6.5}Zn_{0.1}$ | 7 | 109000 |
| 37 | $Fe_{bal.}Cu_1Nb_{3.2}Ta_{0.5}Si_{15.5}B_{6.5}Ag_{0.01}$ | 9 | 110000 |
| 38 | $Fe_{bal.}Cu_1Nb_3Si_{15.8}B_{6.5}In_{0.02}$ | 10 | 101000 |
| 39 | $Fe_{bal.}Cu_1Nb_3Si_{15.8}B_{6.5}Ru_{0.1}$ | 9 | 102000 |
| 40 | $Fe_{bal.}Cu_1Nb_{3.3}Si_{15.7}B_{6.8}Pt_{0.2}$ | 9 | 112000 |
| 41 | $Fe_{bal.}Cu_{0.8}Nb_3Si_{15.5}B_{6.5}Mg_{0.001}$ | 9 | 104000 |
| Comparison | | | |
| 42 | $Fe_{bal.}Cu_1Nb_{2.5}Si_{15}B_2$ | 19 | 42000 |
| 43 | $Fe_{bal.}Cu_1Nb_{2.3}Si_{10}B_{11}$ | 29 | 31000 |
| 44 | $Fe_{bal.}Cu_1Nb_{0.5}Si_{19}B_5$ | 49 | 570 |

EXAMPLE 4

Figure 6A:
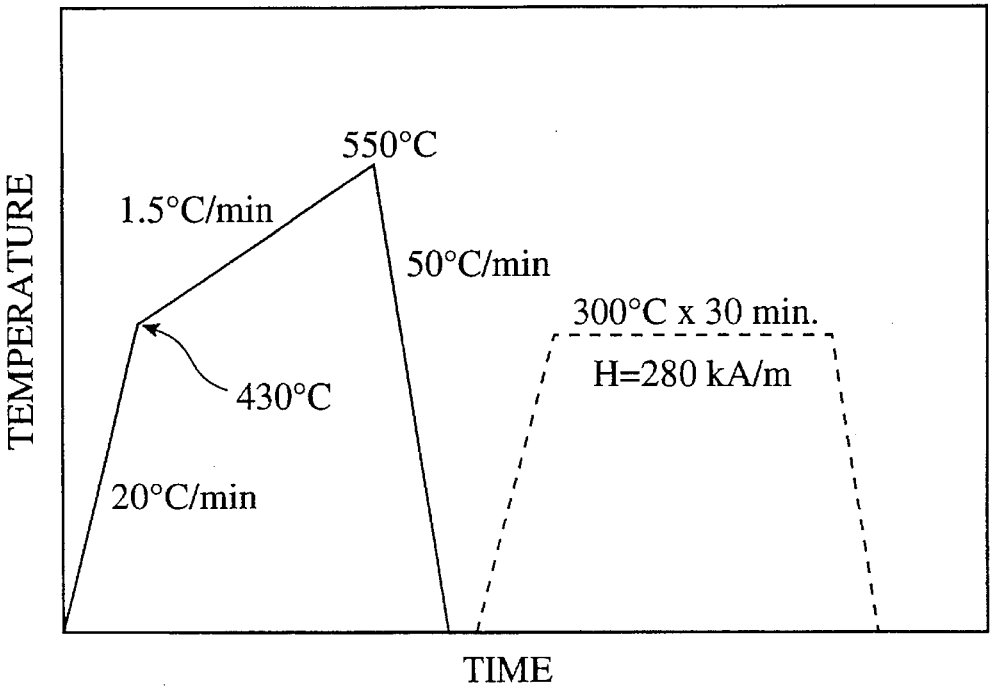
FIGS. 6(*a*) to 6(*c*)are graphs showing the heat treatment patterns of the present invention employed in Example 4.
Figure 6B:
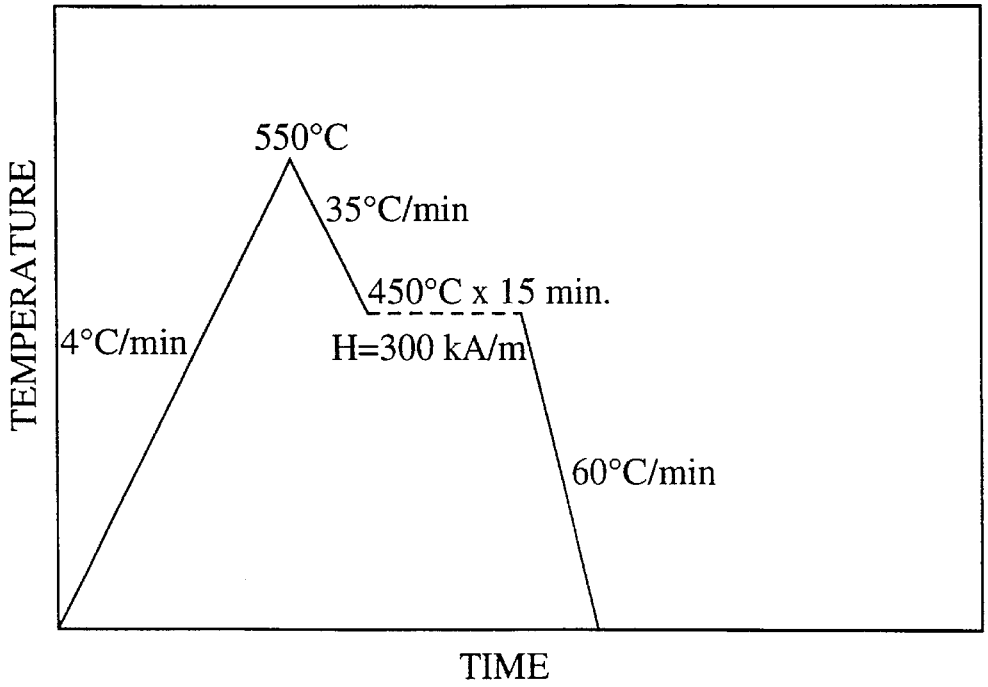
Figure 6C:
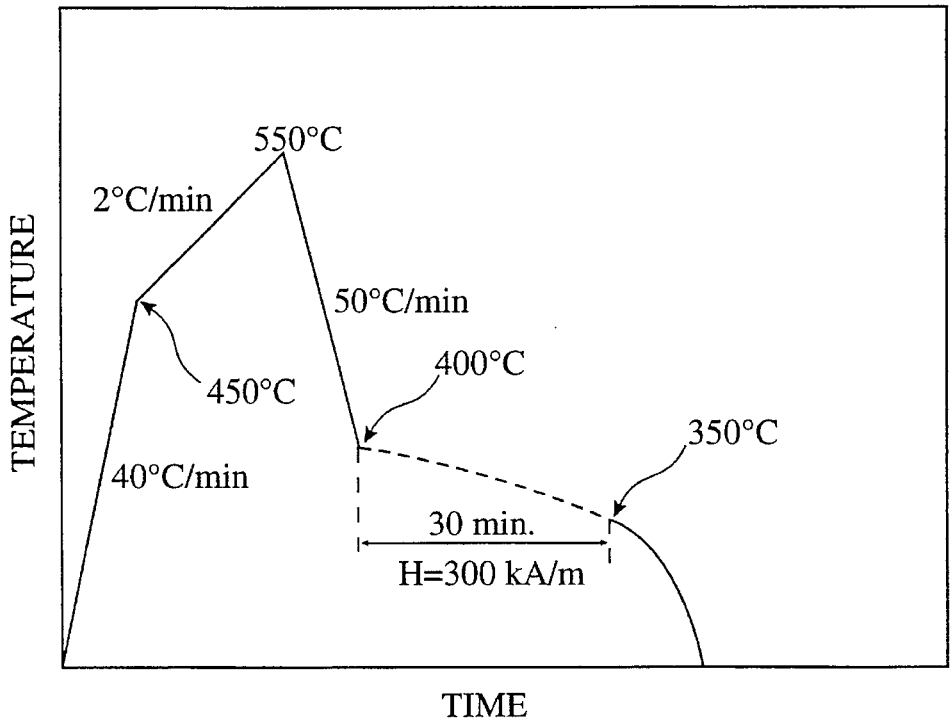

An amorphous alloy ribbon having a with of 10 mm and a thickness of 18 μm was produced by quenching a molten alloy of $Fe_{bal.}Cu_1Nb_{2.5}Cr0.2Si_{14.8}B_{7.5}Sn_{0.05}$ (atomic %)by using a single roll method. The measured crystallization temperature of the amorphous alloy was 490° C. The amorphous alloy ribbon was wound to form a toroidal shape of 30 mm outer diameter and 20 mm inner diameter, and then subjected to heat treatment according to the heat treatment pattern shown in FIG. 6 (a) to (c) to produce each magnetic core made of the nanocrystalline alloy. In FIG. 6, (a) and (c) was conducted in a nitrogen atmosphere, while in a helium atmosphere for (b), and a magnetic field of 280 kA/m was applied in the width direction of the alloy ribbon in (a) while 300 kA/m in the width direction in (b) and (c). For comparison, the same procedure as above was repeated while using a molten alloy having a composition of $Fe_{bal.}Cu_1Nb_{2.5}Si_{10}B_{11}$ (atomic %) which is outside the composition of the present invention. The remanence ratio and specific initial permeability of each resulting magnetic core are also shown in Table 4.

TABLE 4

| Sample No. | Heat Treatment Pattern | Composition (atomic %) | Remanence Ratio $B_r/B_{800}$ (%) | Specific Initial Permeability $\mu_{ir}$ |
|---|---|---|---|---|
| Invention | | | | |
| 45 | (a) | $Fe_{bal.}Cu_1Nb_{2.5}Cr_{0.2}Si_{14.8}B_{7.5}Sn_{0.05}$ | 8 | 112000 |
| 46 | (b) | $Fe_{bal.}Cu_1Nb_{2.5}Cr_{0.2}Si_{14.8}B_{7.5}Sn_{0.05}$ | 8 | 101000 |
| 47 | (c) | $Fe_{bal.}Cu_1Nb_{2.5}Cr_{0.2}Si_{14.8}B_{7.5}Sn_{0.05}$ | 9 | 109000 |
| Comparison | | | | |
| 48 | (a) | $Fe_{bal.}Cu_1Nb_{2.5}Si_{10}B_{11}$ | 19 | 26000 |
| 49 | (b) | $Fe_{bal.}Cu_1Nb_{2.5}Si_{10}B_{11}$ | 20 | 22000 |
| 50 | (c) | $Fe_{bal.}Cu_1Nb_{2.5}Si_{10}B_{11}$ | 23 | 23000 |

As seen from Table 4, the amorphous alloy having the composition within the present invention presented nanocrystalline alloy of a specific initial permeability exceeding 100000, whereas the amorphous alloy having the composition outside the present invention failed to present such a high specific initial permeability even when subjected to the heat treatment of the present invention.

EXAMPLE 5

Figure 7:
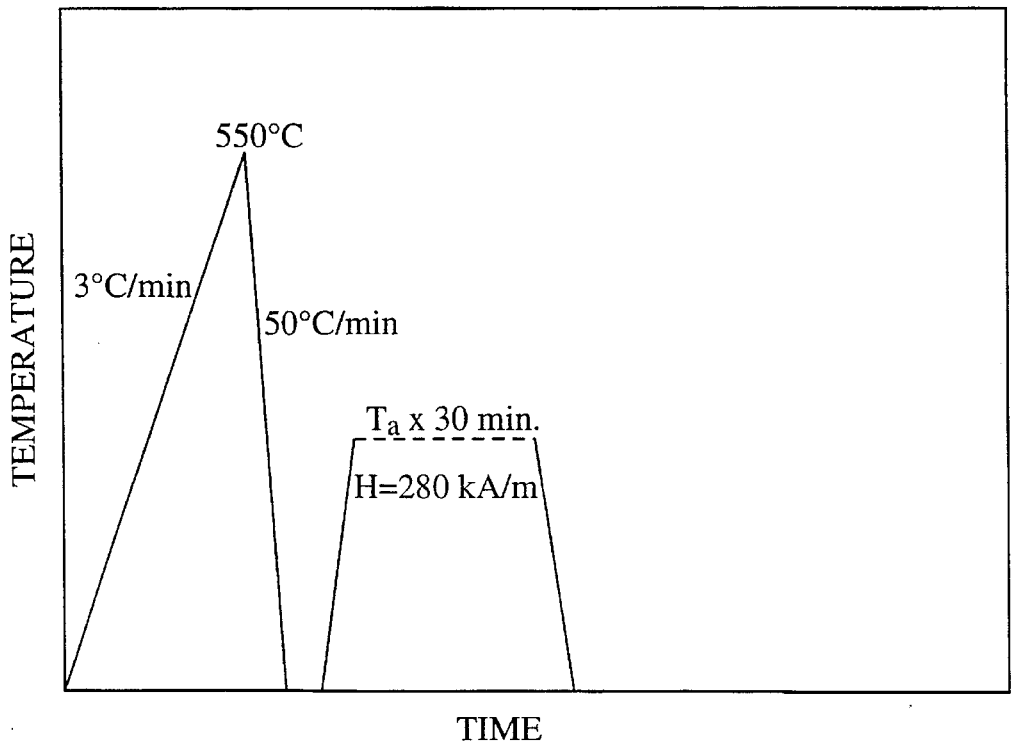
FIG. 7 is a graph showing the heat treatment pattern of the present invention employed in Example 5.

An amorphous alloy ribbon having a width of 12.5 mm and a thickness of 18 μm was produced by quenching a molten alloy having a chemical composition shown in Table 5 by using a single roll method. The amorphous alloy ribbon was wound to form a toroidal shape of 20 mm outer diameter and 14 mm inner diameter, and then subjected to heat treatment according to the heat treatment pattern shown in FIG. 7 while changing the second heat treatment ($T_a$) to produce each magnetic core made of the nanocrystalline alloy. In FIG. 7, the broken line means that the heat treatment was conducted by applying a magnetic field of 280 kA/m in the width direction of the alloy ribbon. The remanence ratio ($B_r/B_{800}$), specific initial permeability ($\mu_{ir}$), magnetic core loss ($P_c$) at 100 kHz and 0.2 T of each resulting magnetic core are also shown in Table 5.

TABLE 5

| Sample No. | Composition (atomic %) | $T_a$ (°C.) | $B_r/B_{800}$ (%) | $\mu_{ir}$ | $P_c$ (kW/m$^3$) |
|---|---|---|---|---|---|
| Invention | | | | | |
| 51 | $Fe_{bal.}Cu_1Nb_3Si_{15}B_9$ | 400 | 8 | 114000 | 230 |
| 52 | $Fe_{bal.}Cu_1Nb_3Ti_{0.7}Si_{15}B_9$ | 350 | 9 | 103000 | 220 |
| 53 | $Fe_{bal.}Cu_1Nb_3Si_{15.7}B_7Sn_{0.01}$ | 300 | 10 | 116000 | 250 |
| 54 | $Fe_{bal.}Cu_1Nb_3Mo_{0.4}Si_{14.5}B_{9.5}$ | 320 | 9 | 106000 | 220 |
| 55 | $Fe_{bal.}Cu_1Nb_3Mo_{0.2}Si_{15.5}B_9$ | 250 | 15 | 114000 | 220 |
| 56 | $Fe_{bal.}Au_{0.8}Nb_3Si_{15.5}B_9Ga_{0.3}$ | 280 | 12 | 115000 | 230 |
| 57 | $Fe_{bal.}Cu_1Nb_3Cr_{0.1}Si_{13}B_{8.5}$ | 340 | 8 | 106000 | 250 |
| 58 | $Fe_{bal.}Cu_1Nb_3Si_{15}B_8Al_{0.01}Sn_{0.08}$ | 450 | 7 | 102000 | 220 |
| 59 | $Fe_{bal.}Cu_1Nb_{2.7}Mo_{0.6}Si_{15}B_9C_{0.01}$ | 420 | 7 | 103000 | 240 |
| 60 | $Fe_{bal.}Cu_{1.5}Nb_{3.5}Si_{14.5}B_8Ge_1$ | 500 | 6 | 100000 | 230 |
| Comparison | | | | | |
| 61 | $Fe_{bal.}Cu_1Nb_3Si_{15}B_9$ | 530 | 16 | 69000 | 290 |
| 62 | $Fe_{bal.}Cu_1Nb_3Si_{15}B_9$ | 520 | 14 | 87000 | 270 |
| 63 | $Fe_{bal.}Cu_1Nb_3Si_{10}B_9$ | 530 | 16 | 27000 | 510 |

As seen from Table 5, when an amorphous alloy having the chemical composition within the present invention was subjected to the heat treatment of the present invention, a low remanence and a specific initial permeability exceeding 100000 were attained. This is because that induced magnetic anisotropy and magnetostriction hardly took place in the present invention. Further, the heat treatment at a temperature over 500° C. in a magnetic field could not provide a specific initial permeability exceeding 100000 even when an amorphous alloy had a chemical composition within the present invention. Thus, since the magnetic core loss is low, the magnetic core produced by the method of the present invention is suitable for use in transformers, choke coils, etc. which are required to be low in the magnetic core loss.

What is claimed is:

1. A method for producing a nanocrystalline alloy comprising the steps of:

(a) heating an amorphous alloy from a temperature lower than the crystallization temperature of said amorphous alloy to a first heat treatment temperature higher than said crystallization temperature, said amorphous alloy having a chemical composition represented by the following formula:

$$(Fe_{1-a}M_a)_{100-x-y-z-b-c-d}A_xM'_yM''_zX_bSi_cB_d \text{ (by atomic \%)},$$

wherein M is at least one element selected from the group consisting of Co and Ni, A is at least one element selected from the group consisting of Cu and Au, M' is at least one element selected from the group consisting of Ti, V, Zr, Nb, Mo, Hf, Ta and W, M" is at least one element selected from the group consisting of Cr, Mn, Sn, Zn, Ag, In, platinum group elements, Mg, Ca, Sr, Y, rare earth elements, N, O and S,X is at least one element selected from the group consisting of C, Ge, Ga, Al and P, and each of a, x, y, z, b, c and d respectively satisfies $0 \leqq a \leqq 0.1$, $0.1 \leqq x \leqq 3$, $1 \leqq y \leqq 10$, $0 \leqq z \leqq 10$, $0 \leqq b \leqq 10$, $11 \leqq c \leqq 17$ and $3 \leqq d \leqq 10$;

(b) keeping the alloy of step (a) at said first heat treatment temperature for 0 to less than 5 minutes; and (c) cooling the heat-treated alloy of step (b) to room temperature at a cooling rate of 20° C./min or more at least until the temperature falls to 400° C.

2. The method according to claim 1, wherein said alloy of step (c) is further subjected to a second heat treatment by the steps of:

(d) heating the alloy of step (c) to a second heat treatment temperature not higher than 500° C. and lower than said first heat treatment temperature;

(e) keeping the temperature of the alloy of step (d) constant at said second heat treatment temperature of in the range from 250° to 500° C. while applying a magnetic field for 2 hours or shorter; and (f) cooling the heat-treated alloy of step (c) to room temperature at a cooling rate of 20° C./min or more at least until the temperature falls to 400° C.

3. The method according to claim 2, wherein said magnetic field is applied in the width direction or in the thickness direction of a thin ribbon of said nanocrystalline alloy.

4. A method for producing a nanocrystalline alloy comprising the steps of:

(a) heating an amorphous alloy from a temperature lower than the crystallization temperature of said amorphous alloy to a first heat treatment temperature higher than said crystallization temperature, said amorphous alloy having a chemical composition represented by the following formula:

$$(Fe_{1-a}M_a)_{100-x-y-z-b-c-d}A_xM'_yM''_zX_bSi_cB_d \text{ (by atomic \%)},$$

wherein M is at least one element selected from the group consisting of Co and Ni, A is at least one element selected from the group consisting of Cu and Au, M' is at least one element selected from the group consisting Ti, V, Zr, Nb, Mo, Hf, Ta and W, M" is at least one element selected from the group consisting of Cr, Mn, Sn, Zn, Ag, In, platinum group elements, Mg, Ca, Sr, Y, rare earth elements, N, O and S, X is at least one element selected from the group consisting of C, Ge, GA, Al and P, and each of a, x, y, z, b, c and d respectively satisfies $0 \leqq a \leqq 0.1$, $0.1 \leqq x \leqq 3$, $1 \leqq y \leqq 10$, $0 \leqq z \leqq 10$, $0 \leqq b \leqq 10$, $11 \leqq c \leqq 17$ and $3 \leqq d \leqq 10$;

(b) keeping the alloy of step (a) at said first heat treatment temperature for 0 to less than 5 minutes;

(c) cooling the alloy of step (b) subjected to a first heat treatment to a second heat treatment temperature not higher than 500° C. and lower than said first heat treatment temperature;

(d) keeping the temperature of the alloy of step (c) constant at said second heat treatment temperature or in the range from 250+ to 500° C. while applying a magnetic field for 2 hours or shorter; and (e) cooling the heat-treated alloy of step (d) to room temperature at a cooling rate of 20° C./min or more at least until the temperature falls to 400° C.

5. The method according to claim 4, wherein said magnetic field is applied in the width direction or in the thickness direction of a thin ribbon of said amorphous alloy.

* * * * *